United States Patent [19]

Soleimani

[11] Patent Number: 4,804,943

[45] Date of Patent: Feb. 14, 1989

[54] REMOTELY CONTROLLED BRIEFCASE ALARM

[76] Inventor: Isaac Soleimani, 138-33 Coolidge Ave., Jamaica, N.Y. 11435

[21] Appl. No.: 69,056

[22] Filed: Jul. 2, 1987

[51] Int. Cl.[4] ..... G08B 1/08; G08B 13/14

[52] U.S. Cl. ..... 340/539; 340/571; 340/572; 340/573; 190/101

[58] Field of Search ..... 340/539, 571, 572, 573, 340/574; 74/543, 547, 551.9; 190/100, 107, 101, 102, 115, 116; 16/110 R, 114 R, DIG. 12

[56] References Cited

U.S. PATENT DOCUMENTS 4,242,668 12/1980 Herzog ..... 340/539

4,591,835 5/1986 Sharp ..... 340/539

FOREIGN PATENT DOCUMENTS 2132804 7/1984 United Kingdom ..... 340/571

*Primary Examiner*—Donnie L. Crosland

*Attorney, Agent, or Firm*—Helfgott & Karas

[57] ABSTRACT

An alarm system for a briefcase. A briefcase is provided with a radio receiver tuned to receive predetermined (such as coded) signals from a remote radio transmitter. The briefcase carries a siren, coupled to the receiver, to give an audible signal of a theft upon actuation of the remote receiver. The briefcase can also be provided with a handle which is normally secured to the briefcase, but which can be made to separate from the briefcase upon actuation of the remote transmitter. An additional mode of operation causes the siren to remain silent until the briefcase is removed a predetermined distance from the remote transmitter, the predetermined signals being continuously received until the briefcase is beyond the range of the transmitter. This mode of operation can also be employed to detach the handle when the briefcase is beyond the range of the transmitter.

7 Claims, 3 Drawing Sheets

FIG. 1
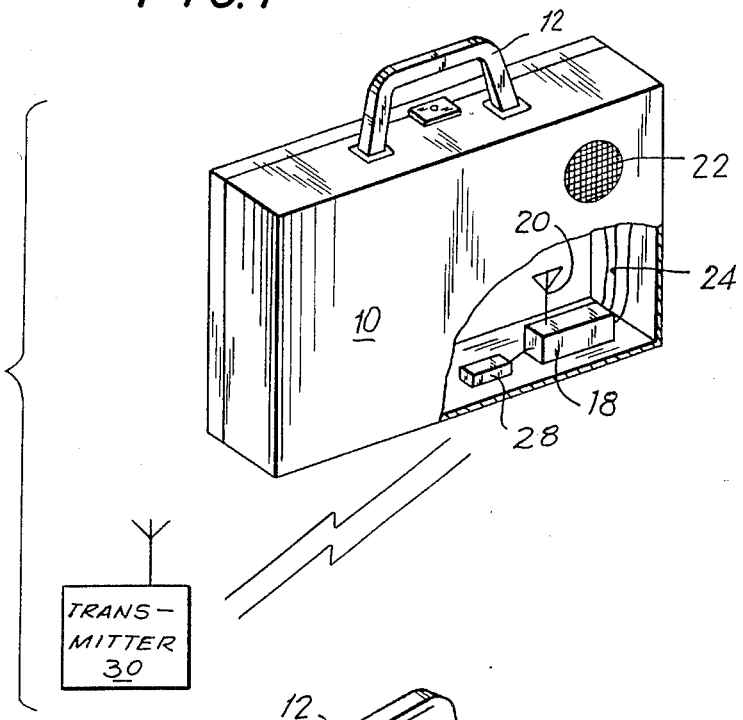
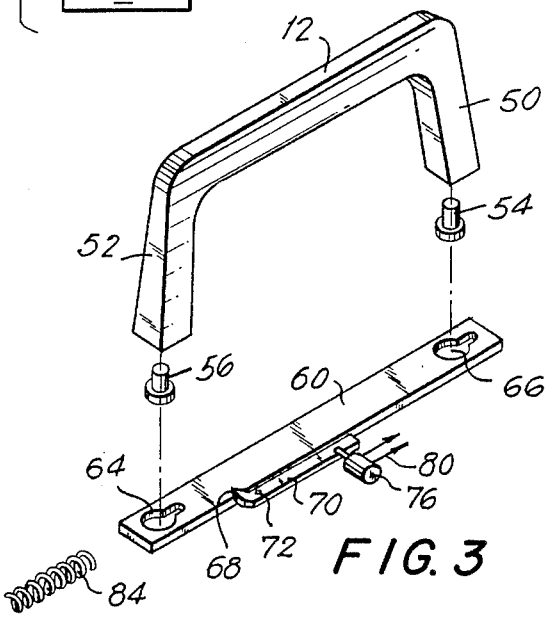
FIG. 3

REMOTELY CONTROLLED BRIEFCASE ALARM

BACKGROUND OF THE INVENTION

This invention relates to alarm systems, and more particularly to a briefcase alarm system.

Briefcase alarm systems are already known, and typically include an alarm or the like within the briefcase which will be activated upon the actuation or release of a button actuated switch or upon opening the briefcase. Typically, the briefcase carries an alarm which becomes activated upon removal of the briefcase from the grip of an authorized person carrying it. Examples of such known constructions are afforded by U.S. Pat. Nos. 548,887 issued to Murphy, No. 851,267 issued to Walsh, No. 1,081,150 issued to Read, No. 1,119.,198 issued to Roth, No. 1,478,169 issued to Butcher, No. 1,701,700 issued to Smith, No. 2,038,625 issued to Adler, No. 2,461,588 issued to Cooper, and No. 2,766,358 issued to

SUMMARY OF THE INVENTION

According to the practice of this invention, the briefcase is provided with a remotely activated alarm. In the event that the briefcase is taken from the possession of an authorized carrier, the owner can remotely activate, by means of coded radio signals, the alarm system to thereby cause a siren within the briefcase to commence operation. The remote control transmitter and receiver circuitry can be of any conventional design, and the range of operation can be limited, such as a few feet or a few hundred yards only.

According to the invention, the alarm can be a siren or harmless smoke. Also within the scope of the invention, the handle can be latched in place by a spring-loaded latch so that when actuated, as by a solenoid and plunger arrangement, a latch is released to thereby cause the separation of the handle from the briefcase, with the result that the briefcase falls on the ground, leaving the thief only with the handle.

Also within the scope of the invention is a spring-loaded device associated with the handle, which causes the handle to snap or clamp on the hand of the thief to thereby inflict pain, and thereby induce the thief to drop the briefcase.

According to a further mode of operation of the invention, the remote transmitter is activated at all times and is operative for a distance of a determined amount, such as 20 feet, whereby should the briefcase be removed beyond this fixed distance, an alarm will sound, or the handle will become unlatched from the remainder of the briefcase. The transmitter can have a second range of, typically, 500 feet, so that the user can selectively control the range, beyond which the alarm in the briefcase will automatically become actuated.

The versatility of the alarm system of this invention is such that it can be formed in a briefcase at the place of manufacture of the latter, or can be retrofitted to existing briefcases.

BRIEF DESCRIPTION OF THE DRAWINGS

FIG. 1 is a partially cut-away perspective view schematically illustrating an alarm system in the briefcase and a radio transmitter.

FIG. 3 is an exploded perspective view illustrating a latch arrangement for detachably mounting the handle to the briefcase, according to a modification of the invention.

DETAILED DESCRIPTION OF THE INVENTION

Figure 2:
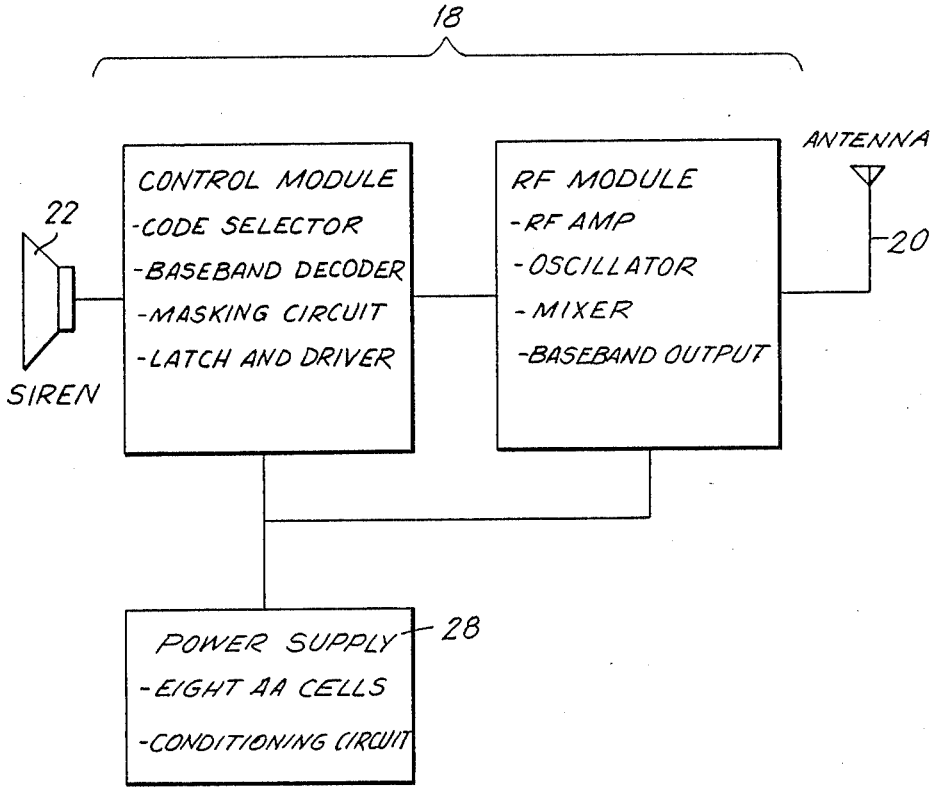
FIG. 2 is a block diagram illustrating typical radio receiver circuitry.

Referring now to FIG. 1 of the drawings, the numeral 10 denotes generally a briefcase of otherwise conventional construction and having a handle 12 mounted on and secured thereto. The numeral 18 denotes a radio receiver, while the numeral 20 denotes an antenna coupled to the receiver. The numeral 22 denotes a siren of conventional construction, which is coupled to the receiver by means of leads 24. The numeral 28 denotes a conventional power supply which may assume the form of batteries mounted in a pack. The numeral 30 denotes a radio transmitter, remotely located from the briefcase, having an antenna denoted by the numeral 32. In practice, the receiver 18 and power supply units 28 are mounted in the bottom of the briefcase and may be secured thereto by any conventional fastening means such as by an adhesive or by fasteners, with antenna 20 secured, as by an adhesive, to an interior wall of the briefcase.

The mode of operation of the invention shown in FIG. 1 is as follows. In the normal course of use, the briefcase is carried from one point to another by an authorized person. No actuation of the siren 22 will be made. On the other hand, in the event of a theft of the briefcase from the authorized person, the authorized person will operate a transmitter 30 carried by the authorized person as, for example, in an inside coat pocket. Upon actuation of the transmitter 30, radio signals will be received by antenna 20 and receiver 18 and siren 22 will be actuated. Thus, within the range of transmission of transmitter 30, it is possible to cause the initiation of siren 22.

FIG. 2 indicates typical circuitry which may be employed. It will be understood, however, that the specific details of the circuitry, as well as whether AM or FM is employed, form no part of the invention.

Another mode of using the invention shown at FIG. 1 is to maintain the transmitter 30 operative at all times for a distance of a fixed amount, such as 20 feet, the circuitry operating to initiate operation of the siren 22 when the briefcase is removed beyond this fixed distance. Further, the transmitter can have a second range of, typically, 500 feet, so that the user can thereby selectively control the range beyond which the siren 22 would automatically be actuated.

Figure 4:
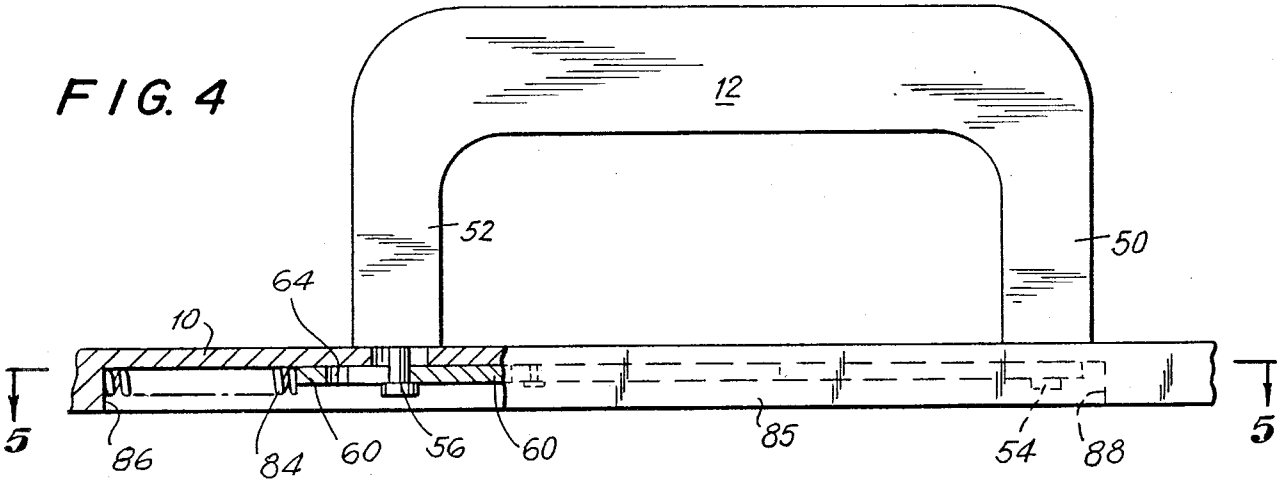
FIG. 4 is a side elevational view of the releasable handle embodiment partially shown at FIG. 3.
Figure 5:
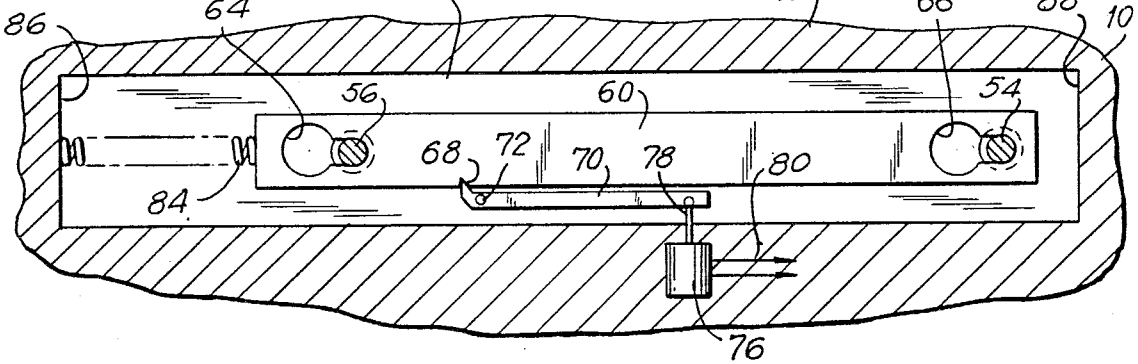
FIG. 5 is a view taken along section 5—5 of FIG. 4.

Referring now to FIGS. 3–5 of the drawings, an alternative embodiment of the invention is illustrated which may be used either in conjunction with siren 22 or instead of it. The numerals 50 and 52 denote respective legs of the handle 12, with numerals 54 and 56 each denoting a headed metal or hard plastic stud having a shank and an enlarged head. The smaller end of these studs may be, typically, screwed into the bottom of and aligned with a respective handle portion 50, 52. The numeral 60 denotes a rigid bar which may be metal or of a rigid plastic material and having spaced keyhole shaped openings 64, and 66, each opening having an enlarged portion communicating with a narrow portion. Numeral 68 denotes a notch at one edge of plate 60, with a tip of a latch lever 70 normally being received in notch 68. Latch lever 70 is mounted on pivot 72. The numeral 76 denotes a solenoid of conventional construction having the usual plunger 78 extending from one end thereof, the solenoid adapted to be energized through leads 80 coupled to the receiver 18. The external end of plunger 78 is secured to an end portion of latch lever 70 on the opposite side of pivot 72. The numeral 84 denotes a compression spring, typically a coil compression spring, being mounted at one end of a recess 85 in a wall portion of the briefcase 10, as indicated at FIG. 4 of the drawings. Thus, one end of biasing spring 84 abuts end surface 86 of recess 85 while the other spring end abuts one end of bar 60. Bar 60 is slidable from its position as shown at FIG. 4 to a position where its right end abuts end surface 88 of recess 85. The bar is held against the upper part of recess 85 by the peripheries of headed studs 56 engaging the peripheries of the narrow portions of keyhole shaped openings 64 and 66.

As seen from a consideration of FIGS. 4 and 5, the handle is in an operative position in the sense that it is coupled to the briefcase 10 so that lifting the handle will lift the briefcase. Latch lever 70 prevents bar 60 from moving to the right under the biasing force of spring 84.

Assume now that the briefcase has been taken from an authorized carrier. In response to an action from the authorized carrier, transmitter 30 will be actuated to thereby send a predetermined signal to receiver 18, with receiver 18 being coupled to solenoid 76 to thereby push plunger 78 towards bar 60, thereby resulting in a pivoting motion of latch lever 70 to cause it to become disengaged from notch 68. Without the latching action, spring 84 pushes bar 60 to the right, to thereby place the enlarged portions of openings 64 and 66 in registry with the enlarged heads of studs 54 and 56, the latter being smaller than the enlarged portions of the keyhole shaped slots. The briefcase will now separate, under the action of gravity, from handle 12, with the result that the thief will remain with the handle only while the body of the briefcase will drop so that it can be retrieved by the authorized user. As in the first described mode, the operation may be such that unlatching of the handle will occur if the briefcase is taken beyond a predetermined distance from transmitter 30.

It should be appreciated that other types of alarms could be utilized, wherein the alarms are triggered by a remote transmitter. The alarms could include visual alarms, sound alarms, smoke emitters, etc. The handle could also be spring loaded so that upon remote triggering it could clamp down hard onto the thief's hand, claming the fingers, between the handle and the top of the briefcase, thereby inflicting pain to the thief, causing him to drop the briefcase.

There has been disclosed the best embodiments of the invention presently contemplated. However, it is to be understood that various changes and modifications may be made thereto without departing from the spirit of the invention.

What is claimed is:

1. A briefcase alarm system including a briefcase having a detachable handle mounted thereon, the handle supporting the briefcase when grasped and lifted, a radio receiver carried by the briefcase, latch means for detachably securing said handle to said briefcase, actuating means operable upon the receipt by said radio receiver of a predetermined radio signal from a radio transmitter remote from the briefcase or upon the absence of the receipt of a predetermined radio signal by said radio receiver to operate said latch means to thereby cause said briefcase, when carried by said handle, to become detached from said handle.

2. The alarm system of claim 1 wherein said actuating means includes a solenoid operated plunger connected to and releasing said latch means.

3. The alarm system of claim 1 wherein said latch means includes a slidable bar mounted on and carried by said briefcase and normally biased to a first, unlatched position and held against said bias in a second, latched position by a latching lever.

4. The alarm system of claim 3 wherein said slidable bar is provided with at least one keyhole shaped slot extending through it and wherein at least one of the ends of said handle is provided with a headed stud projecting through said keyhole shaped slot, the head of said headed stud engaging the narrow side of said keyhole shaped slot in said second position of said bar.

5. A briefcase alarm system comprising: a briefcase, an alarm circuit mounted in said briefcase including a receiver means for receiving a signal from a remote transmitter, a trigger device operated by said receiver means, an alarm means operated by said trigger device, a portable transmitter means separate from said briefcase and operable remotely therefrom for generating a signal for receipt by said receiving means, and a handle attached to the briefcase for being gripped by a hand, said alarm means comprising means for clamping the handle onto the briefcase to grasp a hand therebetween.

6. The alarm system of claim 5, wherein said alarm means is an audible alarm.

7. The alarm system of claim 5, wherein said alarm means is a smoke emitter.

* * * * *